United States Patent [19]

Spodig

[11] 3,960,716

[45] June 1, 1976

[54] MAGNETIC SEPARATOR

[76] Inventor: Heinrich Spodig, Netteberge 84, 4711 Bork, Westphalia, Germany

[22] Filed: Dec. 6, 1973

[21] Appl. No.: 422,573

[30] Foreign Application Priority Data

Dec. 12, 1972 Germany ..... 2260709

[52] U.S. Cl. ..... 209/220; 209/226; 209/229

[51] Int. Cl.[2] ..... B03C 1/12

[58] Field of Search ..... 209/219, 220, 226, 232, 209/229; 210/222, 223

[56] References Cited

UNITED STATES PATENTS

| | | | |
|---|---|---|---|
| 345,246 | 5/1943 | Veglio | 209/219 |
| 940,266 | 11/1909 | Moore | 209/220 |
| 1,527,070 | 2/1925 | Peck | 209/220 |
| 1,714,171 | 5/1929 | Jubke | 209/226 X |
| 2,564,515 | 8/1951 | Vosel | 209/229 X |
| 2,717,080 | 9/1955 | Anderson | 209/222 |
| 2,736,432 | 2/1956 | Gardes | 209/219 X |
| 2,748,940 | 6/1956 | Roth | 209/219 |
| 2,939,580 | 6/1960 | Carpenter | 209/219 |
| 3,186,549 | 6/1965 | Botstiber | 210/222 X |
| 3,289,836 | 12/1966 | Weston | 209/227 X |
| 3,294,237 | 12/1966 | Weston | 209/227 |
| 3,327,852 | 6/1967 | Mortsell | 209/219 |
| 3,684,090 | 8/1972 | Kilbride | 209/227 X |

FOREIGN PATENTS OR APPLICATIONS

| | | | |
|---|---|---|---|
| 78,392 | 2/1919 | Austria | 209/232 |
| 123,087 | 6/1907 | Germany | 209/220 |
| 624,103 | 5/1949 | United Kingdom | 209/220 |
| 681,306 | 10/1952 | United Kingdom | 210/223 |

*Primary Examiner*—Robert Halper
*Attorney, Agent, or Firm*—Michael J. Striker

[57] ABSTRACT

A magnetic system is mounted for rotation in a housing along the inner surface thereof. The housing is stationarily supported in a jacket having an inlet and outlet and defining with the outer surface of the housing a passage for a material containing magnetically attractable particles between the inlet and the outlet. As the material passes through the passage, the magnetically attractable particles are attracted to the outer surface of the housing and dragged along the same to a predetermined location. A scraper has one wall extending tangentially to the outer surface of the housing at the predetermined location and stationary with respect thereto, and another wall which extends substantially radially inwardly of the jacket toward the outer surface of the housing and which is yieldable to prevent the material from reaching the tangential wall but to permit the particles being dragged along the surface to reach the tangential wall, and is provided with a conduit conducting the magnetically attractable particles which have been removed from the outer surface of the housing at the predetermined location by the tangential wall to the exterior of the jacket.

16 Claims, 3 Drawing Figures

MAGNETIC SEPARATOR

BACKGROUND OF THE INVENTION

The present invention relates to a magnetic separator in general and more particularly, to a magnetic separator for dry and wet material containing magnetically attractable particles.

It is already known to provide a magnetic separator having an upright hollow jacket provided with an upwardly directed inlet and a downwardly directed outlet, and a magnetic system supported on a support so as to be concentric to the jacket. It is also already known to provide such a magnetic system with a plurality of magnet disks and a plurality of pole disks alternating with the magnet disks in the axial direction of the jacket. In such an arrangement, the material to be separated, that is, the material containing magnetically attractable particles, is introduced into the hollow jacket, more specifically into an annular space defined by the jacket and the magnetic system, so that the magnetically attractable particles are attracted to the pole disks during the passage of the material through the annular space from the inlet to the outlet of the jacket. This, of course, results in accumulation of the magnetically attractable particles on the pole disks, so that the magnetic system has to be periodically removed from the jacket for cleaning purposes. In order to facilitate the removal operation, the support supporting the magnetic system may be attached to a door hinged to the hollow jacket. Once the magnetic system is removed from the hollow jacket, the cleaning operation is conducted in a conventional manner, such as manually by cleaning brushes or similar devices, or by blasting.

There is also already known a somewhat different magnetic separator of the above type, in which the mangetic system is also arranged concentrically in an upright hollow jacket having an upper inlet portion and a lower outlet portion, the magnetic system being of the type described above having pluralities of pole and magnet disks alternating in the axial direction of the jacket. In this magnetic separator, however, the cleaning operation is conducted automatically, in that a rotating drum is interposed between the pole disks and the hollow jacket and the material to be separated is introduced between the stationary hollow jacket and the rotating drum with attendant attraction of the magnetically attractable particles to the outer surface of the drum. In this arrangement, the magnetic system is stationary and the pole disks thereof are each provided with a recessed portion so that the magnetic field attracting the magnetically attractable particles to the outer surface of the drum is attenuated whenever a particular portion of the drum reaches the region of the recessed portions. As a result of the weakened magnetic field, the magnetically attractable particles which have been attracted to the outer surface of the drum in the region where the magnetic field is strong, are released from the surface in the region of where the magnetic field is weak and fall into a receptacle for magnetically attractable particles. The efficiency of removal of these particles may be further enhanced if a stationary brush is located in the region of the weakened magnetic field and contacts the outer surface of the drum, removing therefrom those magnetically attractable particles which remain at the surface despite the attenuation of the magnetic field. It is evident that such an automatic removal of the magnetically attractable particles is considerably more advantageous than the manual removal thereof.

In this latter arrangement, the magnetically attractable particles which have been attracted to the outer surface of the drum share the movement of the latter until they are released from or brushed off the surface. While this sharing of movement may be advantageous in some magnetic separators, particularly in such separators which are designed for handling materials having distinct magnetically attractable and magnetically not attractable particles, experience has shown that this arrangement does not achieve the desired results whereever the magnetically attractable and not attractable particles have a certain degree of coherence to each other, such as in wet materials or in materials tending to form agglomerations. In this event, the magnetically attractable particles which are attracted to the rotating surface carry along with them to the region of their removal into the receptacle those not magnetically attractable particles hich adhere to them by mechanical bonds, so that the magnetically attractable material received into the receptacle has less than the desired or attainable purity. This, of course, is very undesirable, particularly in view of the present day requirements for purest possible materials and of the difficulties encountered when such magnetically not attractable particles are to be separated from the magnetically attractable particles in a subsequent separation operation.

SUMMARY OF THE INVENTION

It is an object of the present invention to avoid the disadvantages of the prior art magnetic separators.

More particularly, it is an object of the present invention to provide an upright magnetic separator with improved separation of the magnetically attractable particles from the material to be separated.

It is a further object of the present invention to provide a magnetic separator in which the magnetically not attractable particles adhering to the magnetically attractable particles are separated therefrom prior to conducting the latter into a receptacle.

In pursuance of these objects and others which will become apparent hereinafter, the magnetic separator of the above-described type comprises an upright hollow jacket having an upper inlet portion and a lower outlet portion, and a magnetic system concentrically arranged in the jacket. The magnetic system comprises a plurality of magnet disks and a plurality of pole disks which alternate with the magnet disks in the axial direction of the jacket. The magnetic system is surrounded by a housing interposed between the pole disks and the hollow jacket, the inner surface of the housing being adjacent to the pole disks so that the magnetic field of the pole disks penetrates the housing and reaches the outer surface thereof. According to the invention, the housing is stationary with respect to the jacket, and the magnetic system is mounted within the confines of the housing for rotation with respect thereto.

As a result of this arrangement, the magnetically attractable particles which are attracted to the outer surface of the housing by the magnetic field penetrating the housing are being dragged by this field along the above-mentioned outer surface of the housing, due to the rotation of the magnetic system with respect thereto. As a result of this, the frictional forces between the outer surface of the housing and the agglomerations of magnetically attractable and not attractable particles loosens and eventually destroys these agglomerations so that the magnetically not attractable particles which have previously adhered to the magnetically attractable particles by mechanical bonds fall off the surface of the stationary housing before the magnetically attractable particles being dragged along this surface reach a location at which they are removed from the surface and conducted into a receptacle. As a result of this destruction of the agglomerations and removal of the magnetically not attractable particles from the housing prior to removal of the magnetically attractable particles, the purity of the magnetically attractable materials received in the receptacle is considerably improved. This improvement is most pronounced if the material to be separated is of granular, powdery or caking consistency.

According to a currently preferred embodiment of the invention, the housing in which the magnetic system is mounted for rotation has a conical distributor portion facing the inlet of the jacket and spaced therefrom so that the material entering the jacket through the inlet portion thereof is distributed over the surface of the conical portion and proceeds along the same toward the outer surface of the housing which is penetrated by the magnetic field of the magnetic system, so that the magnetically attractable particles of the material are attracted to this surface and dragged along the same in the circumferential direction of the housing toward a location at which the magnetically attractable particles are removed from the surface of the housing. The housing may further comprise a frusto-conical lower portion facing the outlet of the jacket and supported on a support attached to the jacket, so that the frusto-conical lower portion of the housing and the housing itself are held stationary with respect to the jacket. Preferably, the magnetic system is mounted for rotation on a shaft which is mounted in the housing for rotation with respect thereto and which is supported in a lower bearing accommodated in the frusto-conical portion of the housing and in an upper bearing arranged in the conical distributor portion thereof. The shaft is driven by a drive located outside the jacket, via a transmission.

In the currently preferred embodiment of the invention, a scraper is provided adjacent the location at which the magnetically attractable material is to be removed from the outer surface of the housing, the scraper comprising a wall which extends substantially tangentially of the outer surface of the housing, being stationary with respect thereto, and another wall which extends substantially radially of the jacket and in axial parallelism therewith toward the outer surface of the housing and which is yieldable so as to prevent the material being separated from entering the inside of the scraper defined by at least the two above-mentioned walls but permitting the magnetically attractable particles being dragged along the surface of the housing to enter the inside of the scraper, reach the tangentially extending wall thereof and be removed from the outer surface of the housing thereby.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
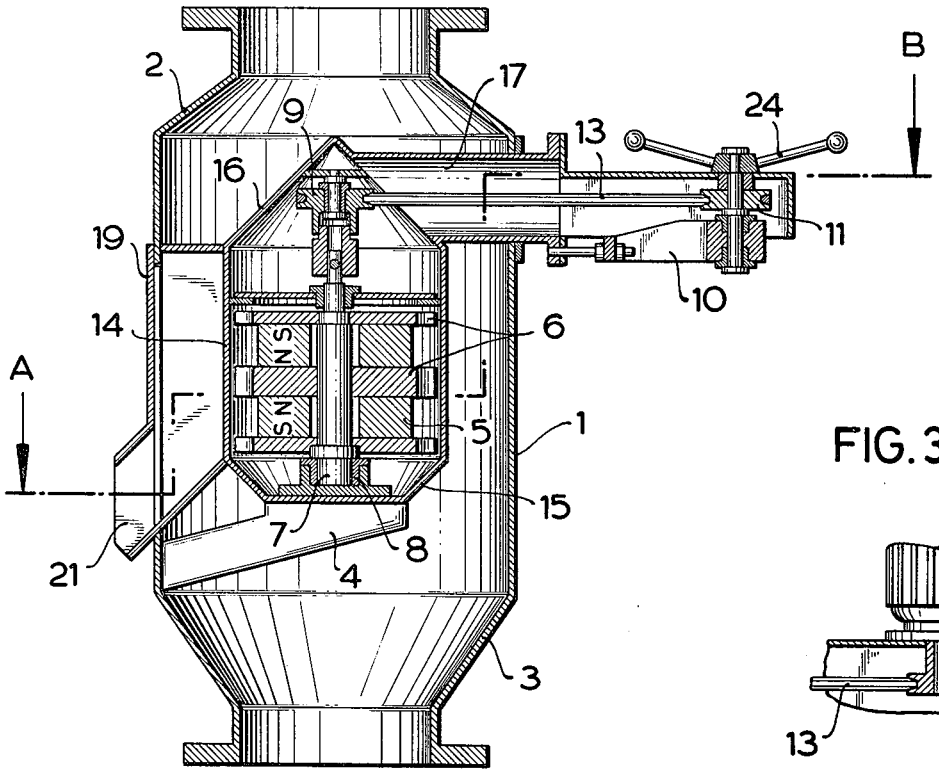
FIG. 1 is a longitudinal sectional view of a magnetic separator taken on line C–D of FIG. 2.
Figure 2:
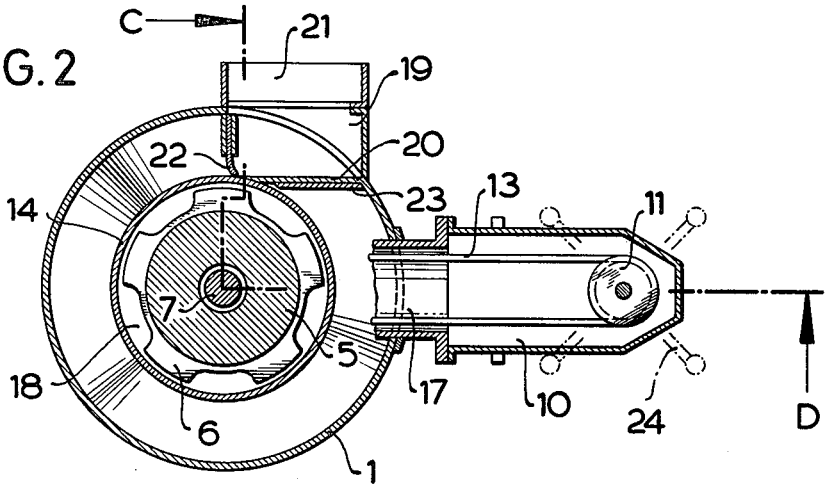
FIG. 2 is a cross-sectional view of the magnetic separator taken on line A–B of FIG. 1.

The magnetic separator illustrated in FIGS. 1 and 2 of the drawing comprises a hollow upright jacket 1 having an upper inlet portion 2 and a lower outlet portion 3 for the material being separated. A support 4 extends radially inwardly of the jacket 1 toward the axis thereof. A magnetic system is mounted within the confines of the jacket 1 for rotation with respect thereto, and comprises a plurality of magnet disks 5 and a plurality of pole disks 6 alternating with the magnet disks 5 in the axial direction of the jacket 1 in such a manner that corresponding poles of the magnet disks 5 abut against and face the respective one of the pole disks 6. The magnet disks 5 and the pole disks 6 are attached to and supported by a shaft 7 which, in turn, is mounted for rotation in a bearing 8 supported by the support 4. The shaft 7 has an end portion spaced from the bearing 8, and a pulley 9 is affixed to this end portion so as to share the movement of the shaft 7. A carrying beam 10 is attached to the jacket 1 and projects radially outwardly therefrom, and a pulley 11 similar to the pulley 9 is supported for rotation in the carrying beam 10. A V-belt extends between and connects the pulley 11 with the pulley 9 serving as a transmission between the same. It is to be understood that any other suitable transmission may be substituted for the V-belt transmission as illustrated and that, if desired, a drive may be located directly on the shaft 7 thus disposing of the need for a transmission. However, in the currently preferred embodiment of the invention, the pulley-V-belt transmission system as described is utilized.

The magnetic system whose shaft 7 is driven via the transmission system by a drive which will be described later on, is accommodated in a housing 14 which is enclosed with respect to the interior of the jacket 1, and the housing 14 has a frusto-conical lower portion 15 which is supported by and connected to the support 4. The housing 14 is arranged coaxially to the jacket 1 and the frusto-conical ortion 15 thereof accommodates the bearing 8 supporting the shaft 7 for rotation with respect to the housing 14. The housing 14 further comprises an upper conical distributor portion 16 which faces the inlet portion 2 of the jacket, being spaced therefrom, and which serves a dual purpose of distributing the material to be separated over the entire surface of the housing 14 and of enclosing the interior of the housing 14 with respect to the exterior thereof. A tubular portion 17 extends between the conical portion 16 and the jacket 1 and establishes communication between the interior or the housing 14 and the exterior of the jacket 1 for passage of the V-belt 13 from the pulley 9 to the pulley 11. The interior surfaces of the jacket 1 and the exterior surfaces of the housing 14, together with the exterior surface of the tubular portion 17 and the support 4 define a passage for the material being separated, extending from the inlet portion 2 to the outlet portion 3 of the jacket 1.

According to a currently preferred embodiment of the invention, the pole disks 6 are provided with recesses 18 which separate a plurality of poles of each pole disk 6 from one another. The provision of these individual poles enchances the operation of the magnetic separator, which will be described later on.

A scraper 19 is provided in the passage for the material to be separated, and comprises a wall 20 abutting against the outer surface of the housing 14 and being stationary with respect thereto. A chute or conduit 21 is defined in the scraper 19 and connects the region of and adjacent to the wall 20 with the exterior of the jacket 1. The scraper 19 also comprises an additional wall 22 which also defines the conduit 21 and which is yieldable and flexible. The wall 20 is provided with a non-magnetic sheet 23 on the side thereof facing away from the conduit 21.

Figure 3:
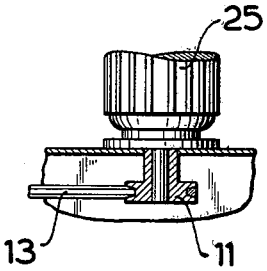
FIG. 3 is a partially sectioned front elevational view of an alternative drive for the magnetic separator of FIG. 1.

The transmission 9, 11, 13 is driven either manually by a hand wheel 24 (viz. FIG. 2) in small separators designed for intermittent operation and for separation of small quantities of material, or by an electromotor 25 or a similar drive, as shown in FIG. 3, for large quantities of material and/or continuous operation.

The above-described device operates as follows:

The material to be separated, which contains magnetically attractable particles interspersed with or forming agglomerations with magnetically not attractable particles, is introduced into the jacket 1 through the inlet portion 2 thereof. Upon entering into the jacket, the material impinges upon the conical portion 16 of the housing 14 facing the inlet and becomes distributed thereby over the entire outer circumferential surface of the housing 14. While the material slides downwardly along the outer circumferential surface of the housing 14, the magnetically attractable particles or the agglomerations containing magnetically attractable particles become attached to the outer circumferential wall of the housing 14, thus ceasing their downward movement while the magnetically not attractable particles of agglomerations continue their movement toward and out of the outlet portion 3 of the jacket 1. The magnetic field generated by the magnet disks 5 and the pole disks 6 penetrates the wall of the housing 14 and, due to the rotation of the magnetic system with respect to the housing 14, the magnetic field generated by the magnetic system also rotates in the same direction as the magnetic system does. Owing to this rotation of the magnetic field, the particles or agglomerations which have been attracted to the outer circumferential surface of the housing 14, are dragged along this surface with resultant friction between the particles or agglomerations and the surface tending to dislodge the agglomerations or separate the magnetically not attractable particles from the magnetically attractable ones. While the magnetically attractable particles remain attracted to the outer surface of the housing, the magnetically not attractable particles fall off the surface and proceed toward the outlet 3 of the jacket 1. The magnetically attractable particles which have been rid of the magnetically not attractable particles which had previously adhered to them, are dragged by the magnetic field penetrating the wall of the housing 14 until they reach the scraper 19, causing the yieldable wall 22 to yield to such an extent as to permit passage of the magnetically attractable particles into the scraper 19. Simultaneously, however, the wall 22 prevents the magnetically not attractable material proceeding in a generally downward direction from entering the scraper 19. Once the magnetically attractable particles are dragged to the wall 20, they proceed in their movement tangentially of the surface of the housing 14 on the wall 20 until the dragging force and thus also the attraction force has been reduced by increasing the distance between the respective particles and the poles of the magnetic system to such an extent that the magnetically attractable particles fall off the wall 20 and into the conduit 21 toward a collecting receptacle. In order to prevent the magnetically attractable particles from being deposited on the surface of the wall 20 which faces away from the interior of the scraper 19 and into the passage, this surface of the wall 20 is shielded by a sheet of non-magnetic material.

It will be understood that each of the elements described above, or two or more together, may also find a useful application in other types of constructions differing from the types described above.

While the invention has been illustrated and described as embodied in an upright magnetic separator, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A magnetic separator for materials containing magnetically attractable particles, comprising a jacket having an inlet and an outlet; a housing having an axis and an outer surface and so mounted within the confines of said jacket as to be stationary with respect thereto and defining therewith a passage between said inlet and said outlet for gravity movement of the material to be separated in a path; connecting means located in said passage and establishing communication between the interior of said housing and the exterior of said jacket; a shaft mounted in said housing for rotation about said axis; drive means for rotating said shaft and including a drive, and a transmission in said connecting means between said shaft and said drive; and magnetic means mounted on said shaft for shared rotation therewith adjacent said housing, including a plurality of magnet disks and a plurality of pole disks alternating with said magnet disks in the axial direction of said housing, and generating a rotating magnetic field which penetrates through said housing into said path whereby the magnetically attractable particles of the material are attracted to said outer surface and dragged along the same circumferentially of said housing to a predetermined location during the rotation of said magnetic means.

2. A magnetic separator as defined in claim 1, and further comprising a support mounting said housing in said jacket.

3. A magnetic separator as defined in claim 1, wherein said jacket is of substantially tubular configuration and said housing is mounted coaxially with said jacket.

4. A magnetic separator as defined in claim 3, wherein said housing comprises a conical portion facing said inlet and axially spaced therefrom.

5. A magnetic separator as defined in claim 1, wherein each of said pole disks comprises a plurality of poles separated from one another by recesses in said pole disks.

6. A magnetic separator as defined in claim 1 wherein said transmission means includes a pulley attached to said shaft, an additional pulley located outside said jacket and mounted for rotation on an additional shaft, said drive for driving said additional shaft, and an endless belt extending between said pulleys and driving said shaft in response to actuation of said drive.

7. A magnetic separator as defined in claim 6, further comprising a supporting beam attached to said jacket and supporting said additional shaft and said drive.

8. A magnetic separator as defined in claim 6, wherein said drive is a manually operated hand wheel.

9. A magnetic separator as defined in claim 6, wherein said drive is a motor.

10. A magnetic separator for materials containing magnetically attractable particles, comprising a jacket of substantially tubular configuration having an inlet and an outlet; a stationary housing having an upright axis and an outer surface and so mounted within the confines of said jacket as to be coaxial and stationary with respect thereto and defining therewith a passage between said inlet and said outlet for gravity movement of the material to be separated in a path; connecting means located in said passage and establishing communication between the interior of said housing and the exterior of said jacket; a shaft mounted in said housing for rotation about said upright axis; drive means for rotating said shaft and including a pulley attached to said shaft, an additional pulley located outside said jacket and mounted on an additional shaft for rotation therewith, a drive for driving said additional shaft, and an endless belt extending between said pulleys and driving said shaft in response to actuation of said drive; magnetic means mounted on said shaft for shared rotation therewith adjacent said housing, including a plurality of magnet disks and a plurality of pole disks alternating with said magnet disks in the axial direction of said housing, and generating a magnetic field which penetrates through said housing into said path whereby the magnetically attractable particles of the material are attracted to said outer surface and dragged along the same circumferentially of said housing to a predetermined location during the rotation of said magnetic means; and means for removing said magnetically attractable particles from said outer surface at said location.

11. A magnetic separator as defined in claim 10, wherein said means for removing said particles is a scraper located in said passage in axial parallelism with said jacket and attached to said housing at said outer surface adjacent said location.

12. A magnetic separator as defined in claim 11, and further comprising conduit means communicating said scraper with the exterior of said jacket.

13. A magnetic separator as defined in claim 11, wherein said scraper is of substantially rectangular configuration and comprises a wall which extends substantially tangentially to said one surface.

14. A magnetic separator as defined in claim 13, wherein said scraper comprises a yieldable wall extending substantially radially inwardly of said jacket toward said outer surface.

15. A magnetic separator for materials containing magnetically attractable particles, comprising a jacket having an inlet and an outlet; a stationary housing having an upright axis and an outer surface and so arranged within the confines of said jacket as to be stationary with respect thereto and defining therewith a passage between said inlet and said outlet for gravity movement of the material to be separated in a path; magnetic means mounted in said housing for rotation about said upright axis adjacent said housing and generating a magnetic field which penetrates through said housing into said path whereby the magnetically attractable particles of the material are attracted to said outer surface and dragged along the same circumferentially of said housing to a predetermined location during the rotation of said magnetic means; means for removing the magnetically attractable particles from said outer surface at said location, including a scraper of substantially rectangular configuration located in said passage in axial parallelism with said jacket and attached to said housing at said outer surface adjacent said location, said scraper including a wall which extends substantially tangentially of said outer surface, and a yieldable wall extending substantially radially inwardly of said jacket toward said outer surface; and conduit means connecting said scraper with the exterior of said jacket.

16. A magnetic separator as defined in claim 15, wherein at least a portion of said yieldable wall is flexible and contacts said surface so as to separate said conduit means from said passage.

* * * * *